US008131191B2

(12) United States Patent
Hirayama et al.

(10) Patent No.: US 8,131,191 B2
(45) Date of Patent: Mar. 6, 2012

(54) IMAGE FORMING APPARATUS AND METHOD FOR DEVELOPING ELECTROSTATIC LATENT IMAGE

(75) Inventors: Junya Hirayama, Takarazuka (JP); Toshiya Natsuhara, Takarazuka (JP); Takeshi Maeyama, Ikeda (JP); Shigeo Uetake, Takatsuki (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 730 days.

(21) Appl. No.: 12/288,527

(22) Filed: Oct. 20, 2008

(65) Prior Publication Data

US 2009/0103957 A1 Apr. 23, 2009

(30) Foreign Application Priority Data

Oct. 22, 2007 (JP) ..... 2007-273496

(51) Int. Cl.
*G03G 15/08* (2006.01)

(52) U.S. Cl. ..... 399/281

(58) Field of Classification Search ..... 399/272, 399/274, 281, 282, 283, 285
See application file for complete search history.

(56) References Cited

U.S. PATENT DOCUMENTS

| | | | | |
|---|---|---|---|---|
| 4,788,570 | A * | 11/1988 | Ogata et al. | 399/283 |
| 5,012,288 | A * | 4/1991 | Tavernier et al. | 399/282 |
| 5,416,566 | A | 5/1995 | Edmunds et al. | |
| 5,545,840 | A * | 8/1996 | Doi et al. | 399/274 |
| 5,689,782 | A | 11/1997 | Murakami et al. | |
| 5,809,386 | A * | 9/1998 | Iwata | 399/281 |
| 5,867,758 | A * | 2/1999 | Yoshida et al. | 399/274 |
| 5,991,587 | A | 11/1999 | Kikuchi | |
| 6,259,876 | B1 * | 7/2001 | Fukuda et al. | 399/272 |
| 6,512,909 | B2 | 1/2003 | Ozawa et al. | |
| 6,724,516 | B2 | 4/2004 | Wang et al. | |
| 7,221,892 | B2 * | 5/2007 | Sato | 399/283 |
| 2008/0181675 | A1 * | 7/2008 | Fujishima et al. | |
| 2009/0067890 | A1 * | 3/2009 | Maeyama et al. | |

FOREIGN PATENT DOCUMENTS

| | | | |
|---|---|---|---|
| JP | 59-172662 | | 9/1984 |
| JP | EP 0414455 | A3 | 2/1991 |
| JP | 03-113474 | | 5/1991 |
| JP | 05-6096 | | 1/1993 |
| JP | 09-185247 | | 7/1997 |
| JP | 10-319708 | | 12/1998 |
| JP | 10-340003 | | 12/1998 |
| JP | 2000-298396 | | 10/2000 |
| JP | 2002108104 | A * | 4/2002 |
| JP | 2003-057882 | | 2/2003 |
| JP | 2005-189708 | | 7/2005 |
| JP | 2007-108673 | | 4/2007 |

* cited by examiner

*Primary Examiner* — Susan Lee
(74) *Attorney, Agent, or Firm* — Brinks Hofer Gilson & Lione

(57) ABSTRACT

Provided are an image forming apparatus equipped with a hybrid developing apparatus including a toner-collecting developer-carrying member and a method for developing an electrostatic latent image, which apparatus is capable of stably forming high definition images without occurrence of a leakage current even under a high-humidity environment. In the apparatus, each of a toner-supplying developer-carrying member and the toner-collecting developer-carrying member has a conductive substrate to which a bias voltage is applied, and at least one of the surfaces of the conductive substrates of the toner-supplying developer-carrying member and the toner-collecting developer-carrying member has a resistive layer formed thereon.

10 Claims, 3 Drawing Sheets

IMAGE FORMING APPARATUS AND METHOD FOR DEVELOPING ELECTROSTATIC LATENT IMAGE

This application is based on Japanese Patent Application No. 2007-273496 filed on Oct. 22, 2007, in Japanese Patent Office, the entire content of which is hereby incorporated by reference.

TECHNICAL FIELD

The present invention relates to an image forming apparatus and a method for developing an electrostatic latent image, in which a latent image on an image carrying member is developer with a developer containing a toner and a carrier.

BACKGROUND

Conventionally, in the image forming apparatus using an electrophotographic method, a single-component developing method, which uses only a toner as a developer and a two component developing method using a toner and a carrier have been known as development methods of an electrostatic latent image formed on an image carrying member. The single-component developing method generally has good image quality. In general, since a thin layer of toner is formed by a regulating plate urged against a toner carrying member and a toner carrying member, it has advantages in simplification of the apparatus, miniaturization and cost reduction. However, the single-component developing method has a shortcoming that a toner is easily degraded by strong stress of a regulation section for charging toner, and the charge-receiving property of a toner is thus rapidly deteriorated. Therefore, a service life of a developing apparatus becomes comparatively short.

Since in the two component developing method, a toner is charged by triboelectric charging by mixing the toner with carrier, it has an advantage that stress given to the toner is small. However, it has problems that a magnetic brush formed of carrier contacts and affects an electrostatic latent image, and carrier adheres on a background of an image.

A hybrid development method, which makes use of the strong points of the single-component developing method and the two component developing method, is proposed in Japanese Patent Application Publication No. H03-113474. A developer is made of the two-component developer containing a carrier and a toner, and the toner is charged by being stirred within a developer container. This developer is conveyed by the developer carrying member (magnet roller), and the toner is adhered onto the surface of the toner carrying member by an electric field. With the toner on the toner carrying member, an electrostatic latent image on an image carrying member is developed. In this hybrid development method, the toner is charged by being mixed with the carrier, and since only the toner performs development, high definition and endurance are both attainable.

However, the hybrid development method has a problem called a development history (ghost), which is a phenomenon that an afterimage of residual toner, which was not used for development, on the toner carrying member appears with a density difference after the following development process.

As a method of solving the problem in this hybrid development method, Japanese Patent Application Publication No. H10-319708 discloses, an apparatus, which is provided with a toner-collecting developer-carrying member for collecting residual toner on the toner carrying member in addition to a toner-supplying developer-carrying member for supplying the toner to the toner carrying member. In this apparatus, the toner-supplying developer-carrying member and the toner-collecting developer-carrying member are closely arranged. And after supplying the toner to the toner carrying member from the toner-supplying developer-carrying member, the developer, in which the toner density fell, is delivered to the toner-collecting developer-carrying member. The toner-collecting developer-carrying member collects the residual toner on the toner carrying member effectively by using this developer (carrier). AS described above, the residual toner is effectively collected from the developer carrying member, and then the developer carrying member is supplied with the toner to be used for the next development, thereby solving the problem of the development history.

However, in the apparatus disclosed by Japanese Patent Application Publication No. H10-319708, the developer (carrier) exists between the toner-supplying developer-carrying member and the toner-collecting developer-carrying member, and there is a problem that leakage current occurs through this developer when under a high-humidity environment. When a large leakage current occurs, toner supply to the toner carrying member and the residual toner collection from the toner carrying member cannot be normally performed, and a problem that a stable image cannot be formed will arise.

In view of the above problems, an object of the present invention is to provide a developing apparatus and an image forming apparatus, which control occurrence of leakage current under a high-humidity environment, which are capable of forming a stable and high definition image while employing a hybrid development method and having a toner-collecting developer-carrying member.

SUMMARY

In view of forgoing, one embodiment according to one aspect of the present invention is an image forming apparatus, comprising:

an image carrying member which is adapted to carry an electrostatic latent image;

a developer container which is adapted to contain a developer including a toner and a carrier for charging the toner;

a toner carrying member which is adapted to convey a toner to a development region, in which the toner carrying member faces the image carrying member, to develop the electrostatic latent image on the image carrying member;

a first developer carrying member which is adapted to carry the developer supplied from the developer container and is disposed facing the toner carrying member to supply the toner included in the developer to the toner carrying member;

a first bias voltage source which is adapted to apply to the first developer carrying member a first bias voltage by which a toner is supplied from the first developer carrying member to the toner carrying member;

a second developer carrying member which is adapted to carry a developer, and is disposed facing the first developer carrying member and facing the toner carrying member in a region which is upstream, in a direction in which the toner carrying member conveys a toner, from the first developer carrying member so as to collect the toner on the toner carrying member and be supplied with the developer on the first developer carrying member; and a second bias voltage source which is adapted to apply to the second developer carrying member a second bias voltage by which the toner on the toner carrying member is collected onto the second developer carrying member, wherein one of the first developer carrying member and the second developer carrying member is provided with a resistive layer on a surface thereof.

According to another aspect of the present invention, another embodiment is a method for developing an electrostatic latent image in an image forming apparatus, the method comprising the steps of:

containing a developer including a toner and a carrier for charging the toner in a developer container;

conveying, by a first developer carrying member, the developer contained in the developer container to a region in which the first developer carrying member faces a toner carrying member;

supplying the toner included in the developer from the first developer carrying member to the toner carrying member by applying a first bias voltage to the first developer carrying member;

developing the electrostatic latent image with the toner supplied to the toner carrying member;

conveying, by the toner carrying member, a toner, which remains on the toner carrying member after the developing of the electrostatic latent image, to a region in which the toner carrying member faces a second developer carrying member; and transferring the toner from the toner carrying member to the second developer carrying member by applying a second bias voltage to the second developer carrying member, wherein at least one of the first developer carrying member and the second developer carrying member is provided with a resistive layer, and the first bias voltage and the second bias voltage cause a current, between the two developer carrying members, through the resistive layer and a developer existing between the two developer carrying members, the current between which two developer carrying members is not more than half a current which would flow if the resistive layer did not exist.

DETAILED DESCRIPTION OF THE PREFERRED EMBODIMENT

Hereafter, an embodiment of the electrophotographic laser beam printer as an image forming apparatus to which the present invention is applied will be described.

Figure 1:
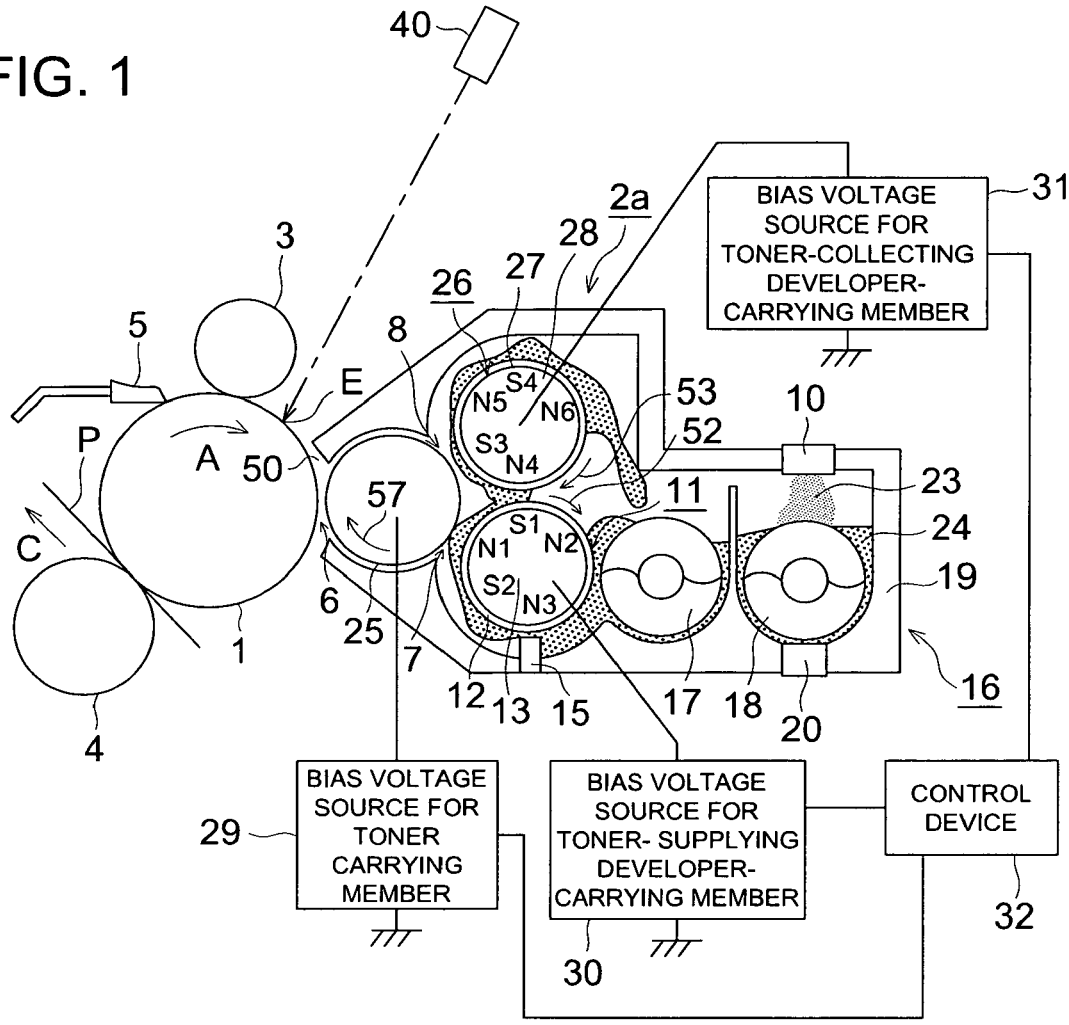
FIG. 1 is a diagram showing a schematic structure of a principal part of an image forming apparatus in a first embodiment according to the present invention.

FIG. 1 shows the schematic structure of a printer of a first embodiment according to the present invention. This printer has an image carrying member (photo conductor) 1 for carrying an image. Around the image carrying member 1, there are arranged along a rotation direction A of the image carrying member 1 in the following order, a charging member 3 for charging the image carrying member 1, developing apparatus 2*a* for developing an electrostatic latent image on the image carrying member 1, transfer roller 4 for transferring the toner image on the image carrying member 1 and cleaning blade 5 for removing a residual toner on the image carrying member 1.

The image carrying member 1 is exposed, at the position of a point E in the figure, by exposing apparatus 40 provided with a laser emission device after being charged by the charging members 3, and an electrostatic latent image is formed on its surface. The developing apparatus 2*a* develops this electrostatic latent image into a toner image. After the transfer roller 4 transfers the toner image on this image carrying member 1 to a transfer medium P, the medium P is ejected in the direction of an arrow C in FIG. 1. The cleaning blade 5 removes by mechanical force the toner, which remains on the image carrying member 1 after the toner image is transferred. The conventional technologies of an electrophotographic method may be arbitrarily used for the image carrying member 1, the charging members 3, the exposing apparatus 40, the transfer roller 4 and the cleaning blade 5, which are used for image forming apparatus. For example, although a charge roller is used as a charging member, it may be a charging apparatus which is not in contact with the image carrying member 1. It is also possible to omit a cleaning blade.

Next, the structure and operations of the developing apparatus 2*a* which are used in this embodiment will be described in detail.

As shown in FIG. 1, the developing apparatus 2*a* equips with an opening 50 on the portion which is opposed the image carrying member 1, and the developing apparatus 2*a* is accommodated in a vicinity of the opening 50 such that a toner carrying member 25 may rotate in the direction of an arrow 57. The toner carrying member 25 is arranged with a predetermined interval between the image carrying member 1 A bias voltage source 29 for the toner carrying member is connected to the toner carrying member 25, and a predetermined development bias Vb can be applied to the toner carrying member 25. As a material of the toner carrying member 25, what is necessary is just that a bias voltage can be applied thereto. For example, it is possible to adopt a metal roller which is configured of aluminum or stainless steel, and particularly an aluminum roller to which surface treatment has been applied is preferred. In addition, the conductive aluminum substrate may be applied with rubber coating of, such as, polyester resin, polycarbonate resin, an acrylic resin, polyethylene resin, polypropylene resin, urethane resin, polyamide resin, polyimide resin, Pol sulfone resin, polyether ketone resin, vinyl chloride resin, acetic acid polyvinyl resin, silicone resin, resin coating of fluoro-resin, silicone rubber, urethane rubber, nitrile rubber, natural rubber or polyisoprene. As a coating material, it is not limited to these, and the electric conductive agent may be added to the bulk or the surface of coating. As an electric conductive agent, an electron conductive agent or an ion conductive agent may be used. As an electron conductive agent, there may be used carbon black, such as the Ketzin black, acetylene black, furnace black, the particulates of metal powder and a metal oxide.

As an ion conductive agent, there may be used a cationic compound, amphoteric compounds, and other ionic polymer materials, such as quaternary ammonium salt.

The toner-supplying developer-carrying member 11 is arranged at the backside (opposite side to the image carrying member 1) of toner carrying member 25 with a predetermined interval. The toner-collecting developer-carrying member 26 is arranged above the toner-supplying developer-carrying member 11 with a predetermined interval between the toner-supplying developer-carrying member 11 and the toner carrying member 25.

The developer container 16 is arranged at the backside of the toner-supplying developer-carrying member 11 and the toner-collecting developer-carrying member 26. The developer container 16 is formed of a casing 19, and accommodates developer 24 containing toner and carrier. Stir-conveyance members 17 and 18 are arranged in the developer container 16. An ATDC (Automatic Toner Density Control) sensor 20 for detecting toner density is disposed at a position which is opposed the lower part of the stir-conveyance member 18 in the casing 19. There is provided a supplying section 10 for supplying a supply toner at a position which is opposed the upper portion of the stir-conveyance member 18. The regulating member 15 is arranged, with a predetermined interval, in the lower part of toner-supplying developer-carrying member 11.

The toner-supplying developer-carrying member 11 is a magnet roller which is configured of a fixed magnet body 13 and a sleeve roller 12 which includes this fixed magnet body 13 and rotates in the direction of an arrow 52. The magnet body 13 has five magnetic poles, N1, S1, N2, N3 and S2, in this order, along the rotational direction (arrow 52 direction) of the sleeve roller 12. The magnetic pole N1 is arranged in a position at the toner supply area 7, which is opposed the toner carrying member 25, and the magnetic pole S1 is arranged at the portion opposite to the toner-collecting developer-carrying member 26, and the space between the magnetic poles N2 and N3 is positioned at the portion opposite to the stir-conveyance member 17. Sleeve roller 12 is connected to a bias voltage source 30 for the toner-supplying developer-carrying member, and a predetermined toner supply bias Vs is applied.

As same in the case of the toner-supplying developer-carrying member 11, the toner-collecting developer-carrying member 26 is also a magnet roller which is configured of a fixed magnet body 28 and sleeve roller 27 which includes this fixed magnet body 28 and rotates in the direction of an arrow 53. At a region where the toner-supplying developer-carrying member 11 and the toner-collecting developer-carrying member 26 face with each other, the moving directions of the surface of both developer carrying members are opposite to each other. The magnet body 28 has five magnetic poles, S3, N5, S4, N6 and N4, in this order, along the rotational direction (arrow 53 direction) of the sleeve roller 27. The magnetic pole S3 is arranged at a position of a toner-collecting region 8 which is opposed the toner carrying member 25, and the magnetic pole S4 is arranged at a portion opposite to the toner-supplying developer-carrying member 11, and the position between the magnetic poles N6 and N4 is positioned at the portion opposite to the stir-conveyance member 17. The sleeve roller 27 is connected to a bias voltage source 31 for the toner-collecting developer-carrying member, and a predetermined toner-collecting bias Vr is applied.

Figure 2:
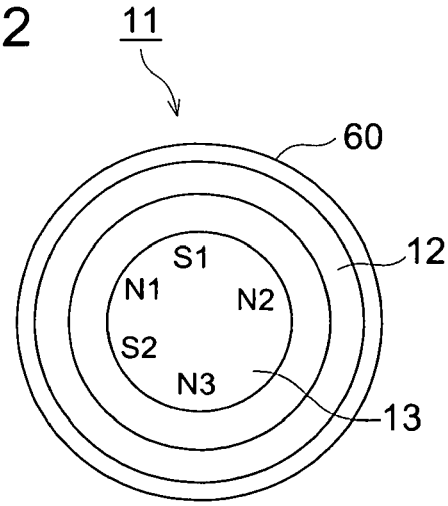
FIG. 2 is a diagram showing the sectional view of a schematic structure of the section of the toner-supplying developer-carrying member provided with a resistive layer.

In this embodiment, a resistive layer is formed at least one of the surface of toner-supplying developer-carrying members 11 and the surface of toner-collecting developer-carrying members 26. For example, as shown in FIG. 2, the resistive layer 60 is provided as a surface of the toner-supplying developer-carrying member 11. This resistive layer 60 is formed on the surface of sleeve roller 12 as a conductive substrate. An electric field is formed between the toner-supplying developer-carrying member 11 and the toner-collecting developer-carrying member 26 by the toner supply bias Vs and the toner-collecting bias Vr. By this electric field, a current flows between the sleeve roller 12 and the sleeve roller 27 through the resistive layer 60 and a developer between the toner-supplying developer-carrying member 11 and the toner-collecting developer-carrying member 26. It is preferred to provide the resistive layer 60 so that the current, which flows through the resistive layer 60, is equal to or less than ½ of the current which would flow through only a developer if the resistive layer 60 did not exist.

The substrate material of the sleeve rollers 12 and 27 should be a conductive material which only has a volume resistance value not more than $1\times10^3$ Ω·cm. As a material of the resistive layer 60, which is formed on at least one of the surface of the sleeve rollers 12 and 27, binder resin into which electric conductive agent is dispersed can be used. Or they may be a metal oxide layer, such as alumite or metal oxide particles. As binder resin, there can be used thermoplastics, such as, polycarbonate, polyester, acrylics, polyvinyl butyral and phenoxy resin, and thermoplastics, such as, alkyd, melamine, urethane, epoxy, silicone and phenol resin. As an electric conductive agent, carbon, ammonium salt or metal oxide particles, metal particles can be used. As metal oxide particles, tin oxide, titanium oxide, an aluminum oxide can be used. To improve the adhesiveness between the resistive layer 60 and the surface of a sleeve roller, a primer layer may be formed on the sleeve roller, and the resistive layer 60 may be formed thereon.

Figure 3:
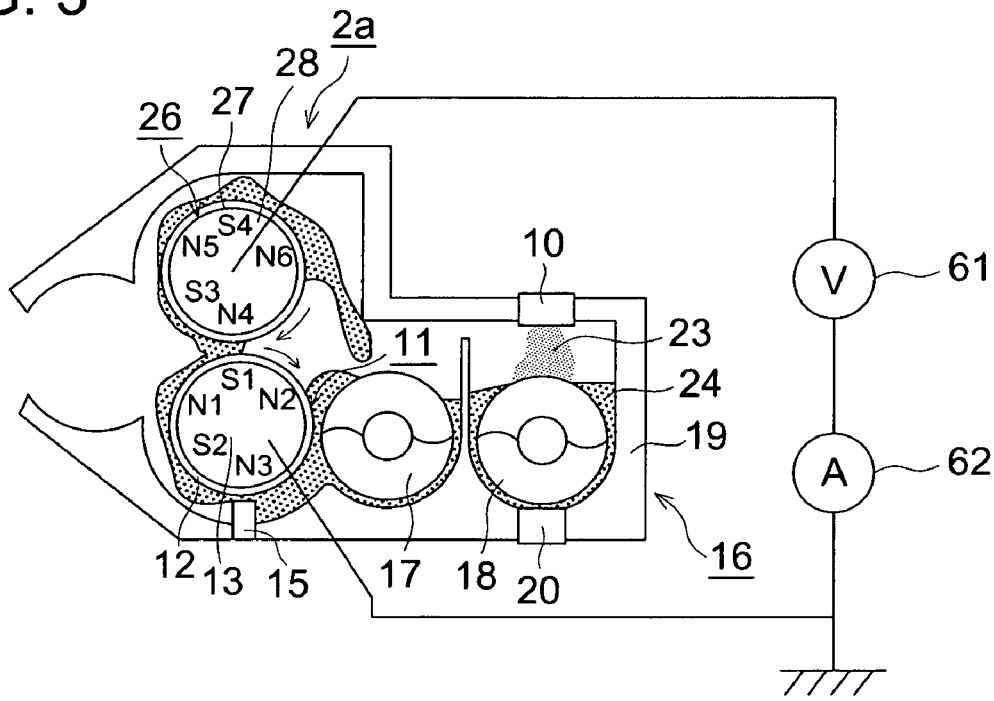
FIG. 3 is a schematic diagram for explaining how to set the resistance of the resistive layer.

A method of setting the resistance of the resistive layer 60 will be described. FIG. 3 shows the state where the toner carrying member 25 has been removed from the developing apparatus 2*a* of FIG. 1. First, the sleeve rollers 12 and 27 which are not provided with the resistive layer 60 are installed in the developing apparatus 2*a*, and the developing apparatus 2*a* is operated with the developer 24 contained. At this time, a predetermined direct-current voltage Vd is applied, from a power supply 61, between the toner-supplying developer-carrying member 11 and the toner-collecting developer-carrying member 26. A current which flows between toner-supplying developer-carrying member 11 and toner-collecting developer-carrying member 26 is measured with an ammeter 62, and the current when there is only developer is obtained. Next, at least one of the sleeve rollers of the toner-supplying developer-carrying member 11 and the toner-collecting developer-carrying member 26 is replaces by a sleeve roller which has a resistive layer. A predetermined direct-current voltage Vd is applied in this state, and a current which flows between the toner-supplying developer-carrying member 11 and the toner-collecting developer-carrying member 26 is measured with an ammeter 62, thereby obtaining the current which flows through the developer and the resistive layer 60. It is preferred to set the resistive layer 60 so that the current is equal to or less than ½ of the current which flows through only the developer when the resistive layer 60 does not exist.

Figure 4:
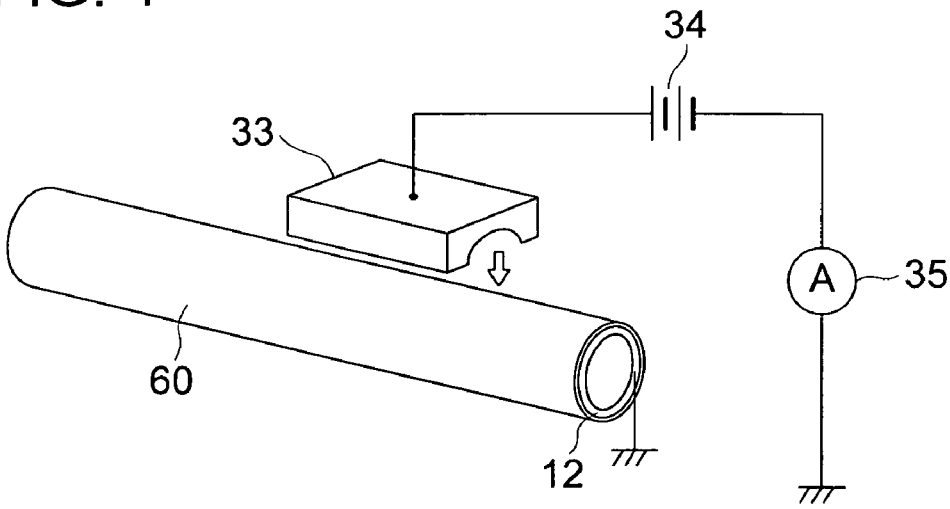
FIG. 4 is a schematic diagram for explaining how to measure the volume resistivity of the resistive layer.

As for the volume resistivity of the resistive layer 60, it is preferably equal to $1\times10^4$ Ω·cm or more and equal to $1\times10^{13}$ Ω·cm or less. In case when the volume resistivity is less than $1\times10^4$ Ω·cm, the thickness of the resistive layer for obtaining predetermined resistance is large. When volume resistivity exceeds $1\times10^{13}$ Ω·cm, an electric charge tends to accumulate on the surface of resistive layer 60. In order to measure the volume resistivity of the resistive layer 60, an arc-shaped electrode 33 is brought into contact with the surface of the sleeve roller 12 on which the resistive layer 60 is formed, as shown in FIG. 4. Next, the resistance is calculated by the applied voltage (V) from the power supply 34 and the current (I) that flows into an ammeter 35 based on Ohm's law. Thereby, the volume resistivity of the resistive layer 60 can be obtained from a contact surface area (electrode surface area) and the thickness of the resistive layer. What is necessary is just to measure the thickness of the resistive layer by using, for example, a film thickness gauge made by Fischer.

The developer 24 is a two-component developer containing toner and carrier for charging toner. The toner is not specifically limited, and a publicly known and generally used toner can be used. For example, a toner made of binder with coloring agent added, a charge control agent and a release agent added if needed, and external agent added can be used. With regard to the toner particle diameter, about 3 to 15 μm is preferred. The carrier is not specifically limited, and a publicly known and generally used carrier can be used, and a binder type carrier, a coat type carrier can be used, for example. With regard to the carrier particle diameter, 15 to 100 μm is preferred. The mixture ratio of toner and carrier has only to be adjusted so that the desired amount of toner charges is obtained, and specifically, it is appropriate that the ratio of the toner is 3 to 50% by mass, preferably 6 to 30% by mass with respect to the total quantity of the toner and the carrier.

Next, a description will be made on the development bias Vb, the supply bias Vs and the collection bias Vr which are applied to the toner carrying member 25, the toner-supplying developer-carrying member 11 and the toner-collecting developer-carrying member 26, respectively. In the developer 24 of this embodiment, toner is charged to a negative polarity and carrier is charged in a positive polarity. The external surface of the image carrying member 1 is charged negative (for example, −600V), and the toner adheres to the portion whose voltage is decreased (for example, −100V) by exposure, thereby performing development. In this case, development bias Vb is set at −400V, the supply bias Vs is set at −450 to −750V, and the collection bias Vr is set at −350 to −50V. These bias values are controlled at a predetermined timing by a control device 32 (FIG. 1) according to the image formation operation. By setting up development bias Vb, supply bias Vs and collection bias Vr, in toner supply region 7, as described above, an electric field is formed, between toner-supplying developer-carrying member 11 and toner carrying member 25, in the direction in which the toner moves from the toner-supplying developer-carrying member 11 toward the toner carrying member 25. On the other hand, in the toner-collecting region 8 between toner-collecting developer-carrying member 26 and toner carrying member 25, an electric field is formed in the direction in which the toner moves from the toner carrying member 25 toward the toner-collecting developer-carrying member 26. It is preferred to superimpose an alternating bias in addition to the direct-current component as the biases applied to either or both of the toner-supplying developer-carrying member 11 and the toner-collecting developer-carrying member 26. Movement of the toner can be promoted by superimposing an alternating bias. In this case, as an AC waveform to be used, various AC waveforms, such as a sine wave, a rectangular wave and a triangular wave can be used. In cases where an alternating bias is used, the biases should be set up so that the average value of the voltage over one cycle satisfies the same magnitude relation as in the case of the above-mentioned direct-current bias.

Development operation of the developing apparatus 2*a* which has the above structure will be described.

In FIG. 1, the developer 24 in the developer container 16 is stirred by the stir-conveyance members 17 and 18, the toner is charged to a negative polarity and the carrier is charged to a positive polarity.

The developer 24 is supplied to the toner-supplying developer-carrying member 11 by the stir-conveyance member 17. The supplied developer 24 is attracted by the magnetic pole N3, and is held on the surface of the sleeve roller 12. The developer 24 held on the sleeve roller 12 forms a magnetic brush in alignment with a line of magnetic force of magnet body 13, the developer is conveyed by the rotation of the sleeve roller 12 in the arrow 52 direction, and the conveyance amount is adjusted by the regulating member 15. Then, the developer 24 is conveyed to the toner supply area 7. The toner in the developer 24 in the toner supply region 7 moves onto the toner carrying member 25 from the toner-supplying developer-carrying member 11 by a voltage difference between the supply bias Vs applied to the toner-supplying developer-carrying member 11 and the development bias Vb applied to the toner carrying member 25. The toner, which has moved onto the toner carrying member 25, is conveyed by the rotation of the toner carrying member 25 in the arrow 57 direction, and an electrostatic latent image on the image carrying member 1 is developed in the development area 6. On the other hand, the developer 24 from which toner has been supplied in the toner supply area 7 moves to the toner-collecting developer-carrying member 26 from the toner-supplying developer-carrying member 11 by the effect of the magnetic pole S1 in the toner-supplying developer-carrying member 11 and the magnetic pole N4 in the toner-collecting developer-carrying member 26. The developer 24, which moved to the toner-collecting developer-carrying member 26, is conveyed by the rotation of the sleeve roller 27 by the rotation in the arrow 53 direction to the toner-collecting region 8. In the toner-collecting region 8, the residual toner on the toner carrying member 25 is scraped off and collected by a magnetic brush of the developer 24 on the toner-collecting developer-carrying member 26, while receiving a force, caused by the voltage difference between the collection bias Vr applied to the toner-collecting developer-carrying member 26 and the development bias Vb applied to the toner carrying member 25, which moves the toner in the direction toward the toner-collecting developer-carrying member 26. This developer 24 having contained this collected residual toner is separated from the surface of toner-collecting developer-carrying member 26 at the homopolar magnetized part of the magnetic poles N6 and N4, and are collected in the developer container 16. The developer 24 collected in the developer container 16 is mixed and stirred by the stir-conveyance members 17 and 18. The toner density in the developer container 16 is periodically detected by the ATDC sensor 20. When the toner density becomes lower than a predetermined value, just the specified quantity of new toner will be supplied from a toner hopper, which is not illustrated, from the supplying section 10. The developer in the developer container 16 is supplied to toner-supplying developer-carrying member 11 in the state where the toner density is kept proper.

As described above, by effectively collecting the residual toner on the toner carrying member 25 in the toner-collecting region 8, a toner can be supplied in the toner supply area 7 under the condition that a development pattern on the toner carrying member 25 has been eliminated. Therefore, an image without a development history can be formed.

In this embodiment, as mentioned above, the resistive layer 60 is formed on at least one of the surfaces of the toner-supplying developer-carrying members 11 and the toner-collecting developer-carrying members 26. By forming this resistive layer 60, a leakage current generated between the toner-supplying developer-carrying member 11 and the toner-collecting developer-carrying member 26 can be prevented. Here, the leakage current means a current which suddenly and non-stationarily flows and is larger by several orders than the current flows, in a normal states during image formation operation, between the toner-supplying developer-carrying member 11 and the toner-collecting developer-carrying member. When this leakage current flows, the outputs of the bias voltage sources will become unstable, thus it will become impossible to perform normal toner supply to the toner carrying member 25 and toner collection from the toner carrying member 25, thereby deteriorating the image quality. This leakage current is easy to occur under a high-humidity environment and due to decrease of a toner density. From this fact, the inventors assumed that the surface resistance of the carrier in the developer is decreased, and an electric charge easily pours into the developer from the surface of the toner-supplying developer-carrying member 11 or the toner-collecting developer-carrying member 26, thereby causing a local high voltage electric field in the developer, and causing a partial short circuit state to cause a leakage current. Based on this assumption, the inventors had formed the resistive layer 60 on at least one of the surfaces of the toner-supplying developer-carrying member 11 and the toner-collecting developer-carrying member 26, thereby having increased the resistance of a path of the leakage current. The study of the resistance of the resistive layer 60 revealed the fact that the resistance of the resistive layers is preferably greater than the resistance of the developer between the toner-supplying developer-carrying member 11 and the toner-collecting developer-carrying member. By providing the resistive layer 60, even if it is under a high-humidity environment, the leakage current can be prevented. As a result, development of an electrostatic latent image on the image carrying member 1 can be stably performed, and a fine image can always be printed.

Next, a second embodiment according to the present invention will be described with reference to FIG. 5. The difference between the first embodiment and the second embodiment is that in a developing apparatus 2*b* of the second embodiment, rotation of a sleeve roller 12 of a toner-supplying developer-carrying member 11 is in the direction of an arrow 54, which is contrary to the first embodiment, and that a regulating member 55 is arranged between magnetic poles S1 and N2. In the second embodiment, the moving direction of the surfaces of both of the developer carrying members is in the same direction in the region where the toner-supplying developer-carrying member 11 and a toner-collecting developer-carrying member 26 face each other. The developer on the toner-supplying developer-carrying member 11 which has passed through the regulating member 55 passes through between the toner-supplying developer-carrying member 11 and the toner-collecting developer-carrying members 26, and a part of the developer moves onto the toner-collecting developer-carrying member 26. With respect to the other structures and setting conditions, since they are the same as those of the first embodiment, the same reference numerals are attached and the explanations are omitted.

The developer 24 in a developer container 16 is stirred by stir-conveyance members 17 and 18, thereby charging the toner to a negative polarity and the carrier to a positive polarity. The developer 24 containing the charged toner and carrier is supplied to the toner-supplying developer-carrying member 11 by the stir-conveyance member 17. The supplied developer 24 is attracted by the magnetic pole N2, and is held on the surface of the sleeve roller 12. The developer 24 held on the sleeve roller 12 forms a magnetic brush in alignment with a line of magnetic force of a magnet body 13, and the developer 24 is conveyed by the rotation of the sleeve roller 12 in the direction of the arrow 54. And the conveyance amount is adjusted by the regulating member 55. Next, the developer 24 is conveyed to between the toner-supplying developer-carrying member 11 and the toner-collecting developer-carrying member 26, and passes through between the toner-supplying developer-carrying member 11 and the toner-collecting developer-carrying members 26. A part of the developer 24 on the toner-supplying developer-carrying member 11 moves onto the toner-collecting developer-carrying member 26 by a magnetic pole N4 at the time of this passage. On the other hand, the developer 24 which remains on the toner-supplying developer-carrying member 11 is conveyed to a toner supply region 7. The toner in the developer 24 in the toner supply region 7 moves onto the toner carrying member 25 from the toner-supplying developer-carrying member 11 by a voltage difference between a supply bias Vs applied to the toner-supplying developer-carrying member 11 and a development bias Vb applied to the toner carrying member 25. The toner which has moved onto the toner carrying member 25 is conveyed by the rotation of the toner carrying member 25 in the direction of an arrow 57, and the surface of an image carrying member 1 is developed in a development region 6. The developer 24 which supplied toner to the toner carrying member 25 in the toner supply region 7 is separated from the toner-supplying developer-carrying member 11 by the homo-polar magnetized part of magnetic poles N3 and N2 of the toner-supplying developer-carrying member 11 and is taken into the developer container 16 by the stir-conveyance member 17. On the other hand, the residual toner after development on the toner carrying member 25 is conveyed to a toner-collecting region 8 by the rotation of the toner carrying member 25. In the toner-collecting region 8, the residual post-development toner on the toner carrying member 25 receives a force which moves the residual development toner in the direction toward the toner-collecting developer-carrying member 26 by the voltage difference between a collection bias Vr applied to the toner-collecting developer-carrying member 26 and the development bias vb applied to the toner carrying member 25. Simultaneously, the residual development toner is scraped by the magnetic brush of the developer 24 on the toner-collecting developer-carrying member 26 to be collected. The developer 24, containing the residual toner collected, on the toner-collecting developer-carrying member 26 is separated from the surface of the toner-collecting developer-carrying member 26 by the homo-polar magnetized part of magnetic poles N6 and N4, and collected into the developer container 16. The developer 24 collected in the developer container 16 is supplied to the toner-supplying developer-carrying member 11, after being mixed and stirred by the stir-conveyance members 17 and 18.

As well as the first embodiment, also in the embodiment of this second embodiment, the residual toner on the toner carrying member 25 is collected in the toner-collecting region 8, and the toner supply region 7 can thus receive supply of toner under the condition where a development pattern on the toner carrying member 25 has disappeared. Consequently, an image can be provided without a development history.

According to an embodiment of the present invention a resistive layer is formed on the surface of conductive substrates of at least the toner-supplying developer-carrying member and the toner-collecting developer-carrying member, and this arrangement enables an occurrence of a leakage current between the toner-supplying developer-carrying member and the toner-collecting developer-carrying member to be controlled even under a high-humidity environment, and a high definition image can be stably provided.

Hereinafter, experimental examples of the first and the second embodiments will be described.

EXPERIMENTAL EXAMPLE 1

An environmental test (room-humidity environment: 25° C., 40%, high-humidity environment: 25° C., 85%) was conducted using an image forming apparatus in which Konica Minolta Business Technologies bizhub C350 has been modified using a developing apparatus 2*a* which has the structure shown in FIG. 1. As a developer, a carrier for Konica Minolta Business Technologies bizhub C350 (volume average particle diameter of about 33 μm) and a toner (volume average particle diameter of about 6.5 μm) were used. Acrylic resin is coated on the surface of the carrier as a coat agent by 3% by mass (about 1 μm). The toner ratio in the developer was set at 8% by mass. The toner ratio is a ratio of the toner to the whole developer.

As the sleeve rollers 12 and 27 of the toner-supplying developer-carrying member 11 and the toner-collecting developer-carrying member 26, aluminum sleeve rollers having the same shape with a diameter of 18 mm were used, and the resistive layers 60 of samples 1 to 10 were formed on their surfaces. The resistive layers 60 of the samples 1 to 10 were formed as follows. One part by mass of polyvinyl-butyral-resin and the range of 0.5 to 1.5 parts by mass of $SnO_2$ were put into THF (tetrahydro franc) and were mixed, thereby having prepared 10 kinds of coating liquid having different $SnO_2$ contents. Each of the coating liquids was applied onto the surface of an aluminum sleeve roller, and dried at 80° C. for 1 hour. And the resistive layers 60 of volume resistivity $2.3\times10^4$ to $5.6\times10^{15}$ Ω·cm having about 2 to 3 μm of a film thickness were formed. Then, the volume resistivity of resistive layers 60 of samples 1 to 10 formed on the aluminum sleeve roller was measured with the apparatus of FIG. 4, and film thickness was measured with a film thickness gauge made by Fischer. Measurement results are shown in Table 1.

TABLE 1

| | Volume resistivity (Ω-cm) | Film thickness (μm) |
|---|---|---|
| Sample 1 | $2.3 \times 10^4$ | 2.5 |
| Sample 2 | $6.5 \times 10^4$ | 3.1 |
| Sample 3 | $9.0 \times 10^6$ | 2.9 |
| Sample 4 | $7.1 \times 10^8$ | 2.4 |
| Sample 5 | $4.5 \times 10^9$ | 2.9 |
| Sample 6 | $2.3 \times 10^{10}$ | 2.5 |
| Sample 7 | $1.3 \times 10^{12}$ | 2.6 |
| Sample 8 | $8.9 \times 10^{13}$ | 2.1 |
| Sample 9 | $2.1 \times 10^{14}$ | 3.2 |
| Sample 10 | $5.6 \times 10^{15}$ | 2.8 |

An aluminum sleeve roller on which each of the resistive layers 60 of samples 1 to 10 was formed was used as the sleeve roller 12 of the toner-supplying developer-carrying member 11 and was set in the current measurement apparatus shown in FIG. 3. The aluminum sleeve roller without a resistive layer 60 was set in the toner-collecting developer-carrying member 26. The electric current flowing through the resistive layer 60 and the developer was measured under the condition where the applied voltage from the power supply 61 was set at DC 100 V and the developing apparatus was driven under the room-humidity environment. The measurement results are shown as <resistive layer is formed on one side> in Table 2.

Next, using two aluminum sleeve rollers of the same sample number on, which each the resistive layers 60 of the samples 1 to 10 was formed, as the sleeve roller 12 of the toner-supplying developer-carrying member 11 and the sleeve roller 27 of the toner-collecting developer-carrying member 26, and they were installed in the current measurement apparatus of FIG. 3. An electric current flowing through the resistive layer 60 and the developer was measured under the condition where the applied voltage from power supply 61 was set at DC 100 V, and the developing apparatus was driven in the room-humidity environment. The measurement results are shown as <resistive layers are formed on both sides> in Table 2.

An electric current, in the case where only the developer layer existed, was measured using aluminum sleeve rollers without the resistive layers 60 in both the toner-supplying developer-carrying member 11 and the toner-collecting developer-carrying member 26. The measurement results will be shown in Table 2 as <no resistive layer>. Please note that, measurements under the following condition were omitted because the measurements were thought to have obtained the same results as <resistive layer is formed on one side> in Table 2. Condition: An aluminum sleeve roller on which each of the resistive layers 60 of the samples 1 to 10 was formed was used as the sleeve roller 27 of the toner-collecting developer-carrying member 26, and an aluminum sleeve roller without the resistive layer 60 was used in the toner-supplying developer-carrying member 11.

TABLE 2

| | Current value (nA) | |
|---|---|---|
| | Resistive layer is provided on one side | Resistive layers are provided on both sides |
| Sample 1 | 455 | 270 |
| Sample 2 | 400 | 220 |
| Sample 3 | 280 | 160 |
| Sample 4 | 260 | 140 |
| Sample 5 | 120 | 70 |
| Sample 6 | 95 | 52 |
| Sample 7 | 76 | 40 |
| Sample 8 | 34 | 15 |
| Sample 9 | 12 | 8 |
| Sample 10 | 3 | 2 |
| No resistive layer | 530 | |

The environmental test was conducted using the image forming apparatus of FIG. 1. The environment test was conducted while varying the three kinds of conditions, as shown in Table 3, where the three kinds of conditions were environment conditions, bias conditions and installation conditions in which an aluminum sleeve roller, with each of the resistive layers 60 of samples 1 to 10 formed thereon, was used as one or both of the toner-supplying developer-carrying member 11 and the toner-collecting developer-carrying member 26.

The installation conditions had the following three options.

<<Supply>> An aluminum sleeve roller with the resistive layer 60 formed thereon was used only as the sleeve roller 12 of the toner-supplying developer-carrying member 11, and an aluminum roller without the resistive layer 60 was used as the sleeve roller 27 of the toner-collecting developer-carrying member 26.

<<Collection>> An aluminum sleeve roller with the resistive layer 60 formed thereon was used only as the sleeve roller 27 of the toner-collecting developer-carrying member 26, and an aluminum roller without the resistive layer 60 was used as the sleeve roller 12 of the toner-supplying developer-carrying member 11.

<<Both>> The same aluminum sleeve roller with the resistive layer 60 formed thereon was used in both of the sleeve rollers 12 and 27 of the toner-supplying developer-carrying member 11 and the toner-collecting developer-carrying member 26.

Bias conditions had the following two options.

<<Bias Condition 1>>

Development bias Vg: AC 1200 Vp-p (3 kHz, Duty 50%) was superimposed on DC −270 V.

Supply bias Vs: DC −420 V,

Collection bias Vr: DC −120 V

<<Bias Conditions 2>>

Development bias Vg: AC 1200 Vp-p (3 kHz, Duty 50%) was superimposed on DC −270V.

Supply bias Vs: DC −420V,

Collection bias Vr: AC 1200 Vp-p (3 kHz, Duty 50%) is superimposed on DC −120 V.

In this environment test, existence or nonexistence of a leakage current was evaluated under the each of the environment conditions while making 50 copies (A4 size, long edge feed) of an A4 chart with an imager ratio of 5%. The grades of evaluation are as follows. D: Abnormal conditions of the output voltage of the bias voltage source for the toner-supplying developer-carrying members or the bias voltage source for the toner-collecting developer-carrying members are observed, and the image quality is not acceptable. C: Abnormal conditions of the output voltage of the bias voltage source for the toner-supplying developer-carrying members or the bias voltage source for the toner-collecting developer-carrying members are observed slightly, but the image quality is acceptable. B: A leakage current is not observed, but there is a small problem in an image quality. A: Abnormal conditions of the output voltage of the bias voltage source for toner-supplying developer-carrying members or the bias voltage source for the toner-collecting developer-carrying members are not observed.

The evaluation results are shown in Table 3. In Table 3 the evaluation results are shown in a matrix table, where the environmental conditions and the sample numbers of the used resistive layers are on the vertical axis, and the setting conditions and the bias conditions are on the horizontal axis.

TABLE 3

| Environmental conditions | | Setting conditions: Supply, Bias conditions 1 | Supply, Bias conditions 2 | Collection, Bias conditions 1 | Both, Bias conditions 1 |
|---|---|---|---|---|---|
| Room humidity | No resistive layer | A | | | |
| High humidity | No resistive layer | D | | | |
| High humidity | Sample 1 | C | C | C | C |
| High humidity | Sample 2 | C | C | C | A |
| High humidity | Sample 3 | A | C | A | A |
| High humidity | Sample 4 | A | A | A | A |
| High humidity | Sample 5 | A | A | A | A |
| High humidity | Sample 6 | A | A | A | A |
| High humidity | Sample 7 | A | A | A | A |
| High humidity | Sample 8 | B | B | B | B |
| High humidity | Sample 9 | B | B | B | B |
| High humidity | Sample 10 | B | B | B | B |

From the results of Table 3, in the case where there is no resistive layers 60 on both of the toner-supplying developer-carrying member 11 and the toner-collecting developer-carrying member 26, abnormal conditions in an image are not observed under the room-humidity environment, however, a leakage current occurred and abnormal conditions in an image were observed under a high-humidity environment. On the other hand, in the case where the resistive layer 60 is provided on at least one of the toner-supplying developer-carrying member 11 and the toner-collecting developer-carrying member 26, under a high-humidity environment, regarding to the samples 1 to 3, an image quality had no problem or was acceptable although a small leakage current was partially observed, regarding to the samples 4 to 10, a leakage current was not observed irrespective of the setting conditions or the bias conditions. Therefore, it is shown that a leakage current is controlled by forming the resistive layer 60 on at least one of the surfaces the toner-supplying developer-carrying member 11 and the toner-collecting developer-carrying member 26. Further, it is shown that in the case where a current flowing through the resistive layers 60 and the developer between the conductive substrate of the toner-supplying developer-carrying member 11 and the conductive substrate of the toner-collecting developer-carrying member 26 is made equal to or lower than ½ of the current which flows in the case where the resistive layers are not formed, a leakage current does not occur under a high-humidity environment irrespective of bias conditions.

In Bs in the Table, when the setting condition is <<supply>>, an image concentration was slightly low by visual observation, when <<collection>>, an image memory was slightly observed, and when <<both>>, an image concentration is slightly low and an image memory was also slightly observed. Since these effects were observed in the case of the samples 8 to 10 where the volume resistivity is over $1\times10^{13}$ Ω·cm, these effects are considered to have occurred because accumulation of an electric charge arose in the resistive layer 60, and the field intensity of the toner supply region and a toner-collecting region have been deteriorated. From these results, the volume resistivity of the resistive layer is $1\times10^{13}$ Ω·cm or lower is preferred. However, when the volume resistivity is made too low, it is necessary to thicken the film thickness of the resistive layer 60 for setting the current to a desirable level. Therefore, the volume resistivity of the resistive layer 60 is preferably set not less than $1\times10^{4}$ Ω·cm and not more than $1\times10^{13}$ Ω·cm.

EXPERIMENTAL EXAMPLE 2

Figure 5:
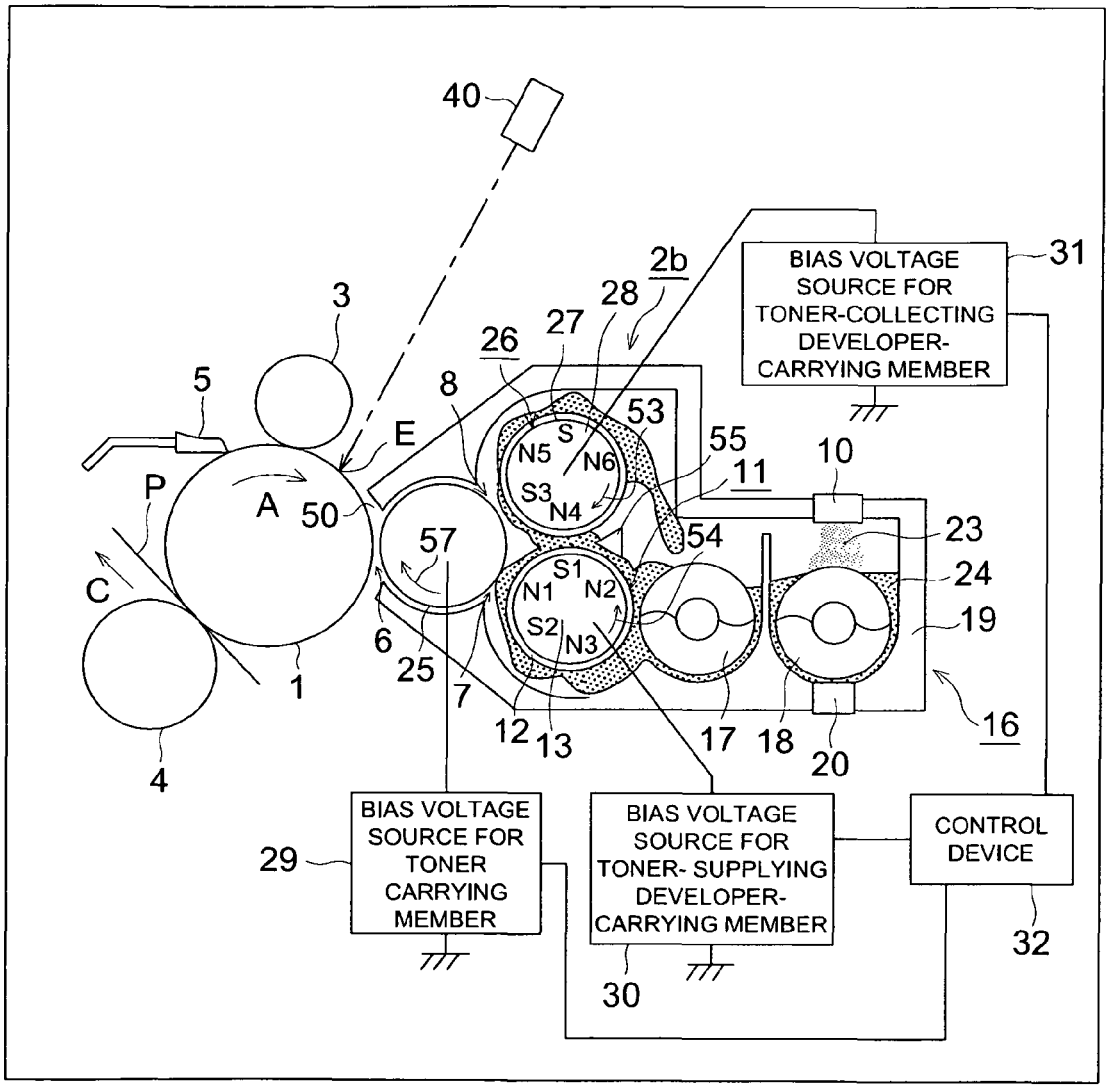
FIG. 5 is a diagram showing a schematic structure of the principal part of an image forming apparatus of a second embodiment according to the present invention.

As the experimental example 2, an environmental test of a leakage current was conducted, in the same way as the experimental example 1, in the case where the developing apparatus 2*b* shown in FIG. 5 is used. The samples of the resistive layers 60 are the same as the samples 1 to 10 used in the experimental example 1. In the developing apparatus 2, the distance between the toner-supplying developer-carrying member 11 and the regulating member 55, and the distance between the toner-supplying developer-carrying member 11 and the toner-collecting developer-carrying member 26 were adjusted to be wider than the case of the developing apparatus 2*a* to efficiently supply and collect the toner in the toner supply region 7 and the toner-collecting region 8.

The aluminum sleeve rollers of the samples 1 to 10, on which the resistive layer 60 was applied, was used as the sleeve roller 12 of the toner-supplying developer-carrying member 11. The toner carrying member 25 was removed from the developing apparatus 2*b*, as the developing apparatus 2*a* shown in FIG. 3 was removed. A voltage of DC 100 V was applied between the toner-supplying developer-carrying member 11 and the toner-collecting developer-carrying member 26, and the developing apparatus 2*b* was driven in the room-humidity environment, and a current flowing through the resistive layer 60 and the developer was measured. The measurement results are shown in Table 4 as <resistive layer is formed on one side>. Further, two aluminum sleeve rollers with the same sample number from the samples 1 to 10, on which the resistive layer 60 was applied, were used as the sleeve roller 12 of the toner-supplying developer-carrying member 11 and the sleeve roller 27 of the toner-collecting developer-carrying member 26, and an electric current was measured in the same way as the experimental example 1. The measurement results are shown in Table 4 as <resistive layer is formed in both sides>. Further, aluminum sleeve rollers without the resistive layer 60 were used in both of the toner-supplying developer-carrying member 11 and the toner-collecting developer-carrying member 26, an electric current, in the case where only the developer existed, was measured. The measurement results are shown in Table 4 as <no resistive layer>. Please note that, omitted were those measurements in the case where an aluminum sleeve roller, on which the resistive layer 60 was formed, was used in the toner-collecting developer-carrying member 26, and an aluminum sleeve roller without the resistive layer 60 was used in the toner-supplying developer-carrying member 11, because the measured currents have the same values as in <resistive layer is formed on one side> of FIG. 4.

TABLE 4

| | Current value (nA) | |
|---|---|---|
| | Resistive layer is provided on one side | Resistive layers are provided on both sides |
| Sample 1 | 705 | 435 |
| Sample 2 | 610 | 350 |
| Sample 3 | 450 | 280 |
| Sample 4 | 414 | 230 |
| Sample 5 | 173 | 105 |
| Sample 6 | 130 | 78 |
| Sample 7 | 104 | 65 |
| Sample 8 | 65 | 38 |
| Sample 9 | 22 | 15 |
| Sample 10 | 4 | 4 |
| No resistive layer | 850 | |

Also in this experimental example 2, the same environmental test as the experimental example 1 was carried out, and it has been evaluated using the same environmental conditions, setting conditions of the resistive layer, and bias conditions. The evaluation result is shown in Table 5.

TABLE 5

| Environmental conditions | | Setting conditions | | | |
|---|---|---|---|---|---|
| | | Supply | Supply | Collection | Both |
| | | Bias conditions | | | |
| | | 1 | 2 | 1 | 1 |
| Room humidity | No resistive layer | A | | | |
| High humidity | No resistive layer | D | | | |
| High humidity | Sample 1 | C | C | C | C |
| High humidity | Sample 2 | C | C | C | A |
| High humidity | Sample 3 | A | C | A | A |
| High humidity | Sample 4 | A | A | A | A |
| High humidity | Sample 5 | A | A | A | A |
| High humidity | Sample 6 | A | A | A | A |
| High humidity | Sample 7 | A | A | A | A |
| High humidity | Sample 8 | B | B | B | B |

TABLE 5-continued

| Environmental conditions | | Setting conditions | | | |
|---|---|---|---|---|---|
| | | Supply | Supply | Collection | Both |
| | | Bias conditions | | | |
| | | 1 | 2 | 1 | 1 |
| High humidity | Sample 9 | B | B | B | B |
| High humidity | Sample 10 | B | B | B | B |

From the results of Table 5, in the case where there is no resistive layers 60 on both of the toner-supplying developer-carrying member 11 and the toner-collecting developer-carrying member 26, abnormal conditions in an image are not observed under the room-humidity environment, however, a leakage current occurred and abnormal conditions in an image were observed under a high-humidity environment. On the other hand, in the case where the resistive layer 60 is provided on at least one of the toner-supplying developer-carrying member 11 and the toner-collecting developer-carrying member 26, under a high-humidity environment, regarding to the samples 1 to 3, an image quality had no problem or was acceptable although a small leakage current was partially observed, regarding to the samples 4 to 10, a leakage current was not observed irrespective of the setting conditions or the bias conditions. Therefore, it is shown, also in the developing apparatus 2*b*, that a leakage current is controlled by forming the resistive layer 60 on at least one of the surfaces the toner-supplying developer-carrying member 11 and the toner-collecting developer-carrying member 26. Further, it is shown that in the case where a current flowing through the resistive layers 60 and the developer between the conductive substrate of the toner-supplying developer-carrying member 11 and the conductive substrate of the toner-collecting developer-carrying member 26 is made equal to or lower than ½ of the current which flows in the case where the resistive layers are not formed, a leakage current does not occur under a high-humidity environment irrespective of bias conditions.

Further, in Bs in the Table 5, when the setting condition of the resistive layer is <<supply>>, an image concentration was slightly low by visual observation, when <<collection>>, an image memory was slightly observed, and when <<both>>, an image concentration is slightly low and an image memory was also slightly observed. Since these effects were observed in the case of the samples 8 to 10 where the volume resistivity is over $1\times10^{13}$ Ω·cm, these effects are considered to have occurred because accumulation of an electric charge arose in the resistive layer 60, and the field intensity of the toner supply region and a toner-collecting region have been deteriorated. From these results, the volume resistivity of the resistive layer is $1\times10^{13}$ Ω·cm or lower is preferred. However, when the volume resistivity is made too low, it is necessary to thicken the film thickness of the resistive layer 60 for setting the current to a desirable level. Therefore, the volume resistivity of the resistive layer 60 is preferably set not less than $1\times10^{4}$ Ω·cm and not more than $1\times10^{13}$ Ω·cm.

What is claimed is:

1. An image forming apparatus, comprising:

an image carrying member configured to carry an electrostatic latent image;

a developer container configured to contain a developer including a toner and a carrier for charging the toner;

a toner carrying member configured to convey a toner to a development region, in which the toner carrying member faces the image carrying member, to develop the electrostatic latent image on the image carrying member;

a first developer carrying member configured to carry the developer supplied from the developer container and is disposed facing the toner carrying member to supply the toner included in the developer to the toner carrying member;

a first bias voltage source configured to apply to the first developer carrying member a first bias voltage by which a toner is supplied from the first developer carrying member to the toner carrying member;

a second developer carrying member configured to carry a developer, and is disposed facing the first developer carrying member and facing the toner carrying member in a region which is upstream, in a direction in which the toner carrying member conveys a toner, from the first developer carrying member so as to collect the toner on the toner carrying member and be supplied with the developer on the first developer carrying member; and a second bias voltage source configured to apply to the second developer carrying member a second bias voltage by which the toner on the toner carrying member is collected onto the second developer carrying member, wherein one of the first developer carrying member and the second developer carrying member is provided with a resistive layer on a surface thereof, and the first bias voltage and the second bias voltage cause a current between the first developer carrying member and the second developer carrying member, through a developer existing between the two developer carrying members, the current between which two developer carrying members is not more than half a current which would flow if the resistive layer did not exist.

2. An image forming apparatus, comprising:

an image carrying member configured to carry an electrostatic latent image;

a developer container configured to contain a developer including a toner and a carrier for charging the toner;

a toner carrying member configured to convey a toner to a development region, in which the toner carrying member faces the image carrying member, to develop the electrostatic latent image on the image carrying member;

a first developer carrying member configured to carry the developer supplied from the developer container and is disposed facing the toner carrying member to supply the toner included in the developer to the toner carrying member;

a first bias voltage source configured to apply to the first developer carrying member a first bias voltage by which a toner is supplied from the first developer carrying member to the toner carrying member;

a second developer carrying member configured to carry a developer, and is disposed facing the first developer carrying member and facing the toner carrying member in a region which is upstream, in a direction in which the toner carrying member conveys a toner, from the first developer carrying member so as to collect the toner on the toner carrying member and be supplied with the developer on the first developer carrying member; and a second bias voltage source configured to apply to the second developer carrying member a second bias voltage by which the toner on the toner carrying member is collected onto the second developer carrying member, wherein one of the first developer carrying member and the second developer carrying member is provided with a resistive layer on a surface thereof, and the resistive layer has a volume resistance of no less than $1\times10^{4}$ Ω·cm and not more than $1\times10^{13}$ Ω·cm.

3. The image forming apparatus of claim 2, wherein the resistive layer is formed on a surface of the second developer carrying member.

4. The image forming apparatus of claim 2, wherein a surface of the first developer carrying member and a surface of the second developer carrying member move in the same direction in a region in which the first developer carrying member and the second developer carrying member face each other.

5. The image forming apparatus of claim 2, wherein each of the first developer carrying member and the second developer carrying member contains a magnet in an inside thereof, and the carrier has a magnetic property to be held by the first developer carrying member and the second developer carrying member.

6. An image forming apparatus, comprising:

an image carrying member configured to carry an electrostatic latent image;

a developer container configured to contain a developer including a toner and a carrier for charging the toner;

a toner carrying member configured to convey a toner to a development region, in which the toner carrying member faces the image carrying member, to develop the electrostatic latent image on the image carrying member;

a first developer carrying member configured to carry the developer supplied from the developer container and is disposed facing the toner carrying member to supply the toner included in the developer to the toner carrying member;

a first bias voltage source configured to apply to the first developer carrying member a first bias voltage by which a toner is supplied from the first developer carrying member to the toner carrying member;

a second developer carrying member configured to carry a developer, and is disposed facing the first developer carrying member and facing the toner carrying member in a region which is upstream, in a direction in which the toner carrying member conveys a toner, from the first developer carrying member so as to collect the toner on the toner carrying member and be supplied with the developer on the first developer carrying member; and a second bias voltage source configured to apply to the second developer carrying member a second bias voltage by which the toner on the toner carrying member is collected onto the second developer carrying member, wherein one of the first developer carrying member and the second developer carrying member is provided with a resistive layer on a surface thereof, and the resistive layer is formed on a surface of the first developer carrying member.

7. An image forming apparatus, comprising:

an image carrying member configured to carry an electrostatic latent image;

a developer container configured to contain a developer including a toner and a carrier for charging the toner;

a toner carrying member configured to convey a toner to a development region, in which the toner carrying member faces the image carrying member, to develop the electrostatic latent image on the image carrying member;

a first developer carrying member configured to carry the developer supplied from the developer container and is disposed facing the toner carrying member to supply the toner included in the developer to the toner carrying member;

a first bias voltage source configured to apply to the first developer carrying member a first bias voltage by which a toner is supplied from the first developer carrying member to the toner carrying member;

a second developer carrying member configured to carry a developer, and is disposed facing the first developer carrying member and facing the toner carrying member in a region which is upstream, in a direction in which the toner carrying member conveys a toner, from the first developer carrying member so as to collect the toner on the toner carrying member and be supplied with the developer on the first developer carrying member; and a second bias voltage source configured to apply to the second developer carrying member a second bias voltage by which the toner on the toner carrying member is collected onto the second developer carrying member, wherein each of the first developer carrying member and the second developer carrying member is provided with a resistive layer on a surface thereof.

8. An image forming apparatus, comprising:

an image carrying member configured to carry an electrostatic latent image;

a developer container configured to contain a developer including a toner and a carrier for charging the toner;

a toner carrying member configured to convey a toner to a development region, in which the toner carrying member faces the image carrying member, to develop the electrostatic latent image on the image carrying member;

a first developer carrying member configured to carry the developer supplied from the developer container and is disposed facing the toner carrying member to supply the toner included in the developer to the toner carrying member;

a first bias voltage source configured to apply to the first developer carrying member a first bias voltage by which a toner is supplied from the first developer carrying member to the toner carrying member;

a second developer carrying member configured to carry a developer, and is disposed facing the first developer carrying member and facing the toner carrying member in a region which is upstream, in a direction in which the toner carrying member conveys a toner, from the first developer carrying member so as to collect the toner on the toner carrying member and be supplied with the developer on the first developer carrying member; and a second bias voltage source configured to apply to the second developer carrying member a second bias voltage by which the toner on the toner carrying member is collected onto the second developer carrying member, wherein one of the first developer carrying member and the second developer carrying member is provided with a resistive layer on a surface thereof, and a surface of the first developer carrying member and a surface of the second developer carrying member move in opposite directions relative to each other in a region in which the first developer carrying member and the second developer carrying member face each other.

9. An image forming apparatus, comprising:

an image carrying member configured to carry an electrostatic latent image;

a developer container configured to contain a developer including a toner and a carrier for charging the toner;

a toner carrying member configured to convey a toner to a development region, in which the toner carrying member faces the image carrying member, to develop the electrostatic latent image on the image carrying member;

a first developer carrying member configured to carry the developer supplied from the developer container and is disposed facing the toner carrying member to supply the toner included in the developer to the toner carrying member;

a first bias voltage source configured to apply to the first developer carrying member a first bias voltage by which a toner is supplied from the first developer carrying member to the toner carrying member;

a second developer carrying member configured to carry a developer, and is disposed facing the first developer carrying member and facing the toner carrying member in a region which is upstream, in a direction in which the toner carrying member conveys a toner, from the first developer carrying member so as to collect the toner on the toner carrying member and be supplied with the developer on the first developer carrying member; and a second bias voltage source configured to apply to the second developer carrying member a second bias voltage by which the toner on the toner carrying member is collected onto the second developer carrying member, wherein one of the first developer carrying member and the second developer carrying member is provided with a resistive layer on a surface thereof, and the first bias voltage and the second bias voltage form an alternating electric field between the first developer carrying member and the second developer carrying member.

10. A method for developing an electrostatic latent image in an image forming apparatus, the method comprising the steps of:

containing a developer including a toner and a carrier for charging the toner in a developer container;

conveying, by a first developer carrying member, the developer contained in the developer container to a region in which the first developer carrying member faces a toner carrying member;

supplying the toner included in the developer from the first developer carrying member to the toner carrying member by applying a first bias voltage to the first developer carrying member;

developing the electrostatic latent image with the toner supplied to the toner carrying member;

conveying, by the toner carrying member, a toner, which remains on the toner carrying member after the developing of the electrostatic latent image, to a region in which the toner carrying member faces a second developer carrying member; and transferring the toner from the toner carrying member to the second developer carrying member by applying a second bias voltage to the second developer carrying member, wherein at least one of the first developer carrying member and the second developer carrying member is provided with a resistive layer, and the first bias voltage and the second bias voltage cause a current, between the two developer carrying members, through the resistive layer and a developer existing between the two developer carrying members, the current between which two developer carrying members is not more than half a current which would flow if the resistive layer did not exist.

* * * * *